United States Patent [19]

Frauenfeld et al.

[11] Patent Number: 4,577,678

[45] Date of Patent: Mar. 25, 1986

[54] STORAGE MATERIAL FOR HEAT TRANSFER

[75] Inventors: Martin Frauenfeld, Heidelberg; Rüdiger von Wedel, Heiligkreuzsteinach-Eiterbach, both of Fed. Rep. of Germany

[73] Assignee: Kraftanlagen AG, Heidelberg, Fed. Rep. of Germany

[21] Appl. No.: 718,022

[22] PCT Filed: Jun. 23, 1984

[86] PCT No.: PCT/EP84/00189

§ 371 Date: Mar. 22, 1985

§ 102(e) Date: Mar. 22, 1985

[87] PCT Pub. No.: WO85/00879

PCT Pub. Date: Feb. 28, 1985

[30] Foreign Application Priority Data

Aug. 8, 1983 [DE] Fed. Rep. of Germany ..... 3328548

[51] Int. Cl.[4] ..... F28D 17/02; F28D 19/04

[52] U.S. Cl. ..... 165/10; 165/905

[58] Field of Search ..... 165/10, DIG. 8

[56] References Cited

U.S. PATENT DOCUMENTS 2,706,109 4/1955 Odman ..... 165/10

4,114,597 9/1978 Erb .

FOREIGN PATENT DOCUMENTS 0010817 5/1980 European Pat. Off. .
3007525 9/1981 Fed. Rep. of Germany .
3137296 4/1983 Fed. Rep. of Germany .
2103583 4/1972 France .
2166063 8/1973 France .
2230403 12/1974 France .
2267534 11/1975 France .
2339830 8/1977 France .
2482116 11/1981 France .
7407020 5/1973 Netherlands .
888636 1/1962 United Kingdom .
2075656 11/1982 United Kingdom .

*Primary Examiner*—Albert W. Davis, Jr.

[57] ABSTRACT

The storage material is intended for the transfer of heat between gas streams in heat exchangers, and has stick-like molded spacing elements (12) on the one hand, and a plurality of plate-like molded elements (12) of heat-resistant plastic serving as storage elements on the other, which are assembled into storage blocks. Polyetherimide is used as the material for the molded elements (10; 12), which combines sufficiently high heat resistance with resistance to aggressive chemical influences.

11 Claims, 8 Drawing Figures

STORAGE MATERIAL FOR HEAT TRANSFER

The invention relates to a storage material for the transfer of heat between gas streams in heat exchangers, composed of stick-like profiled spacing elements and a plurality of plate-like molded elements serving as storage elements made of heat-resistant plastic, which are assembled into storage blocks.

Such a storage material is known from German publication DE-A No. 32 07 213. In it, the stick-like profiled spacing elements and the heat-storing, plate-like molded elements are made from polyphenylene oxide or a copolymer of polyphenylene oxide and polystyrene, or from polyblends of polyphenylene oxide and polystyrene.

On the other hand, it is the object of the invention further to improve the long-term stability of the storage material while simultaneously achieving a higher temperature level. Moreover, the preparation of the storage material from the plate-like and stick-like molded elements is to be facilitated.

Setting out from a storage material of the kind mentioned above, this object is achieved by making the molded elements from polyetherimide. Imides of high molecular weight are known in the plastics art mainly as heat-resistant thermosets. By the incorporation of imides of high thermal stability and strength into amorphous polyethers by means of ether bonds, i.e., compounds of higher molecular weight having numerous ether bonds, polyetherimides are now available which have thermoplastic properties, i.e., they are easy to form into molded elements on account of their good rheological qualities and melt stability, and can be fabricated by all methods commonly used with thermoplastics. Thus, both injection-molding and extrusion methods can be used for making them into stick-like and plate-like molded elements. Due to the high thermal stability, the mass temperatures are to be selected between 340° and 425° C., preferably around 400° C. Care must be taken only to see that heated tools are used for fabrication whose surface has a temperature between 70° and 170° C., preferably around 95° C. By selecting optimum fabricating temperatures, optimum properties are obtained in the finished molded elements on account of the better rheological characteristics of the material, such as for example high strength in the flow seams and high resistance to heat and chemicals, combined with optimum cycle times despite the amorphous material.

The joining of the stick-like spacing elements and of the plate-like heat-storing elements can then be performed, as in the known storage material, by ultrasonic welding, transitions in the form of studs of triangular cross section, for example, being provided in the areas to be joined so as to give a particularly great strength to the bond after the ultrasonic welding.

Alternatively, the molded elements can also be joined to one another to form storage blocks by cementing, and this refers both to joining the molded elements by an adhesive cementing using cements on the basis of polyurethane, silicone, nonaminic epoxy resins or polyamide hot-melt adhesives, and to joining by means of diffusion cementing using a solvent for polyetherimide, preferably methylene chloride in concentration of 1% to 5%. In the latter case, the parts to be joined are softened by the solvent in the area of the junction, and these surfaces are bonded together under pressure. After the solvent evaporates, a virtually monolithic bonding of the molded elements is achieved, i.e., no foreign matter having material properties different from those of the molded elements is left in the seam. To join by cementing, the areas to be joined are to be fitted accurately to one another, and before they are cemented they must be cleansed thoroughly of grease, oil and dust; isopropyl alcohol is suitable for this purpose. In all cementing processes, furthermore, the application of pressure for a certain length of time after joining is important to the integrity of the bond.

Independently of such cementing of the profile elements, or in addition to such cementing, it is desirable, on the basis of the material properties as regards their elongation under tensile stress, their flexibility and their elasticity, to provide the molded elements in the areas of the intended junctions with alternately mating button-like or cleat-like snap-fastening means.

In an alternative embodiment of the invention, the storage blocks can be composed of perforated plate-like molded elements and stick-like molded elements provided with rivet heads, the rivet heads being formed or swaged preferably by ultrasonic action.

Particularly when the plate-like molded elements are to have an especially slight thickness, it may be desirable to reinforce the polyetherimide used in making them by embedding fibers or fibrous fabrics, preferably glass fibers or glass fiber fabrics, in them. Fiber contents can amount to up to 10%, without thereby losing the resilient properties of the material which are essential to the creation of snap fastenings.

For assembly into storage blocks by one of the above-mentioned cementing methods, it may be advantageous for the stick-like molded elements to be formed integrally with the plate-like molded elements. Then such combination elements can be manufactured by injection molding, or also by extrusion, while appropriately configuring the elements used for making the cementable or snap-fastening junctions. For example, a junction can be made by providing upstanding portions at the stick-like areas, these portions having a thickened edge and being snapped into slots in the plate-like areas of the joining elements.

Since polyetherimide absorbs as much as 0.25% of water within 24 hours, the material should be dried before fabrication to less than 0.05% moisture content, e.g., by heating in a drying oven for a certain length of time.

The storage blocks made from the stick-like and plate-like molded elements or of integral joining elements in accordance with the invention have a high resistance to aggressive chemicals, such as for example a large number of hydrocarbon compounds, mineral acids as well as salt solutions and aqueous lyes with a pH of 9. Furthermore, the storage blocks have a high stability of shape and a sufficient long-term stability, even over relatively long periods under stress, at higher working temperatures of up to 170° C.

The invention will be further explained in the description that follows of a number of embodiments, in conjunction with the drawing, wherein.

Figure 8:
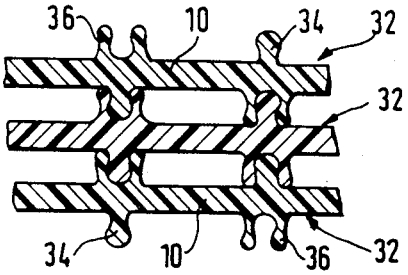
Figure 6:
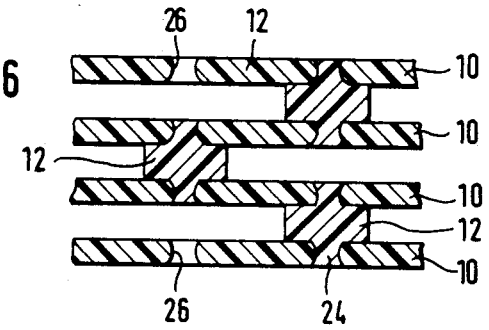
FIG. 6 is a cross-sectional view seen in the direction of the arrows 6—6 in FIG. 5.
Figure 7:
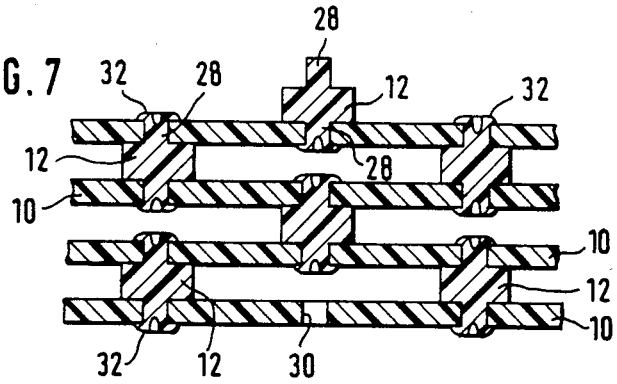

FIG. 7 is a cross-sectional view taken in the same manner as FIG. 6 through a pack of molded elements in which the stick-like molded elements are joined to the plate-like molded elements by riveting with rivet heads produced by ultrasonic forming; and FIG. 8 is a cross-sectional view taken in the same manner as FIG. 6 or 7 through a pack of molded elements having cleat-like molded elements formed integrally on the plate-like molded elements.

Figure 1:
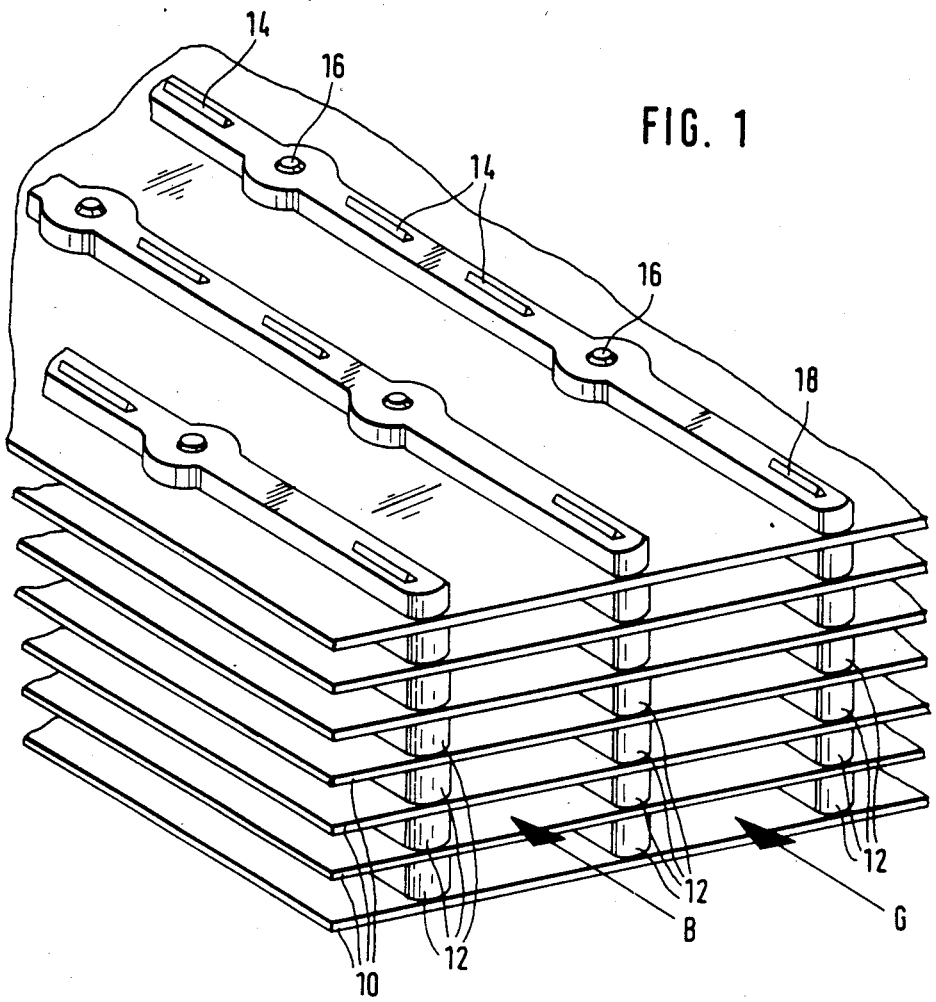
FIG. 1 is a perspective view of a pack of stick-like and plate-like molded elements joinable by ultrasonic welding in the preparation of a storage block.

In FIG. 1, seven plate-like molded elements 10 alternate with stick-like spacing moldings 12 in three rows one over the other, all joined together by ultrasonic welding. The next-following layer of stick-like spacing moldings 12 has already been laid on the top molded element 10 of the plate pack. For welding to the next (not shown) molded element, the molded spacing elements 12 are provided on both sides, i.e., also on the bottom not visible in the drawing, with the cleats 14 of triangular cross section disposed in the axial direction and represented on their upper side, on the one hand, and on the other hand they are provided with circular studs 16 for spot welds. Prior to the ultrasonic welding, first the next plate-like molded element is placed on the uppermost layer of the stick-like spacing element 12. The ultrasonic welding thus takes place step-wise simultaneously through a remote weld joining the bottom of the stick-like molded elements 12 to the plate-like molded element beneath them, and through a proximate weld to join their upper side to the plate-like molded element that is yet to be placed on them.

The stick-like molded spacing elements are provided, in the area of the spot welds to be made on them, with rounded, circular-shaped expansions, so that in these areas particularly sturdy, button-like junction areas are formed. In the section of the plate pack represented in the drawing, the rectilinear front edges of the plate-like molded elements represented on the right side of the drawing are situated at the area of the later entrance of the dust-laden gases, whose direction of flow may be symbolized by the arrow G. The cleaning jets of a soot blower, whose direction of action may be represented by the arrow B, act in the same direction.

The molded spacing bars 12 are provided with expansions which are set back from the above-mentioned entry front and have the studs 16, of circular plan, for the ultrasonic spot welds.

Immediately adjacent the entrance end there are provided the prismatic projections 18, shorter than the other prismatic projections 14 running lengthwise of the stick-like moldings, which serve only for aid in assembly. They fix the storage block or pack of molded elements in the area of the entrance end, where they prevent deformation by the ultrasonic welding performed stepwise during the assembly of the storage block from the plate-like and stick-like molded elements. In later operation, the welds made with the projections 18 can break open, so that the plate-like molded elements 10 will form a section capable of vibration in the entrance area.

Figure 2:
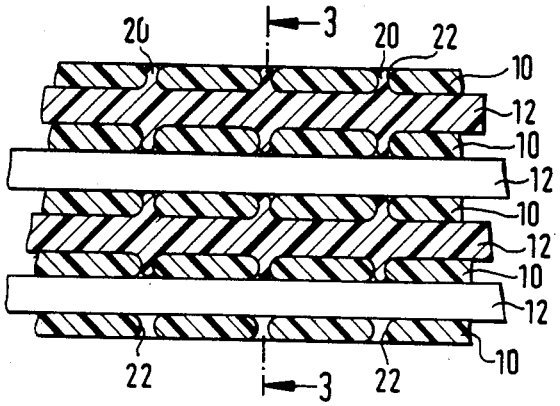
FIG. 2 is a cross sectional view taken through a pack of stick-like and plate-like molded elements configured appropriately for snap-fastening, in the lengthwise direction of the stick-like pieces, as seen in the direction of the arrows 2—2 in FIG. 3.
Figure 3:
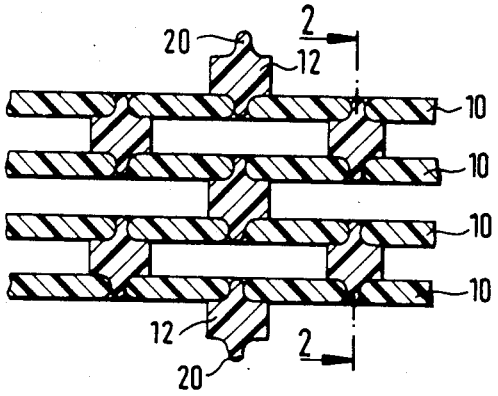
FIG. 3 is a cross-sectional view taken along the arrows 3—3 in FIG. 2.

In the case of the pack shown in FIGS. 2 and 3, the the plate-like molded elements are snap-fastened to the stick-like molding elements 12; for this purpose, studs 20 whose heads are thickened project from the opposite flat sides of the stick-like molded elements 12 at regular intervals, and the studs are snapped into associated bores 22 in the molded elements 10. The studs 20 are opposite one another on the top and bottom of the stick-like molded elements 12, as it can be seen in FIG. 2. On the other hand, the stick-like molded elements 12 are spaced apart between successive plate-like molded elements 10 by the amount of spacing provided between adjacent bores 22 in the molded elements 10.

Figure 4:
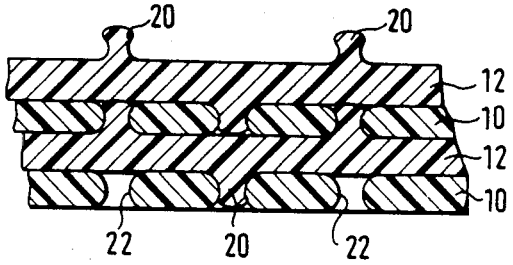
FIG. 4 shows a pack of molded elements produced by snap-fastening, with molded elements different from those used in FIGS. 2 and 3, in a cross-section similar to FIG. 2.

In the pack of molded elements shown in FIG. 4, the stick-like molded elements 12 again have studs 20 with thickened heads, which are snapped into associated bores 22 in the plate-like molded elements 10; the studs 20 on opposite sides of the stick-like molded elements, however, are spaced apart by an amount which is equal to twice the distance between centers of adjacent bores 22 in the plate-like molded elements, and the studs 20 on the top and bottom of the molded elements 12 are offset from one another by the distance between centers of adjacent bores 22 in the molded elements 10. It is thus possible to arrange the stick-like molded elements 12 in packs one over the other without lateral misalignment between successive molded elements 10, as in the case of the plate pack represented in FIG. 1.

Figure 5:
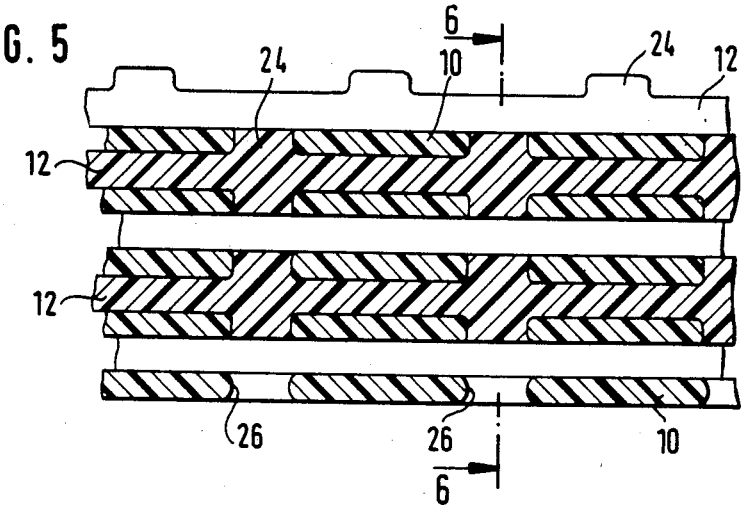
FIG. 5 is a cross-sectional view taken in the same manner as FIGS. 2 and 4 through a pack of stick-like and plate-like molded elements configured in a manner suitable for joining by cementing.

FIGS. 5 and 6 show a pack of molded elements constructed similarly to the pack shown in FIGS. 2 and 3; in this pack, however, the molded elements 10 and 12 are not snap-fastened together but joined by cementing. Instead of the studs 20 of circular cross section, elongated projections 24 are formed on the stick-like molded elements, and these projections fit matingly into associated slots 26. To join the molded elements 10 and 12 together, the projections are inserted into the slots 26 with a cement, or the surfaces which engage one another in the slots are softened with a solvent prior to the assembly of each molded element 10. After the solvent evaporates, the projections 24 are then bonded in a virtually monolithic manner to the associated walls of the slot 26.

In FIG. 7 is shown a method of joining the stick-like molded element 12 to the plate-like molded elements 10, in which, again, studs of circular cross section projecting from the opposite flat sides of the stick-like molded elements 12 are inserted into associated bores 30 in the plate-like molded elements 10. The fixing of the studs 28 in the bores, however, is accomplished by forming rivet heads 32 on the free ends of the studs by swaging these stud ends with ultrasound.

Lastly, FIG. 8 shows still another pack of combination elements 32, in which the stick-like molded elements are formed virtually integrally with the plate-like molded elements 10. In the present case, different stick-like molded elements 34 and 36, alternating and set apart from one another each by the spacing between adjacent stick-like molded elements are provided on opposite sides of the plate-like molded elements 10. The one molded element 34 of these elements is a relatively narrow strip provided on its free end with a head portion of circularly thickened cross section, while the second molded element 36 is in the form of a wider stip having a longitudinal groove complementary to the molded element 34. The molded elements 34 of the one plate 32 can thus be snapped into the molded elements 36 of the next plate 32 in the pack.

What is claimed is:

1. Storage material for the transfer of heat between gas streams in heat exchangers, composed of stick-like molded spacing elements and a plurality of plate-like molded elements (12) serving as storage elements of heat-resistant plastic, which are assembled into storage blocks, characterized in that the molded elements (10; 12; 32) are made from polyetherimide.

2. Storage material of claim 1, characterized in that the stick-like molded spacing elements and the heat-storing plate-like molded elements (12; 10) are joined together by ultrasonic welding.

3. Storage material of claim 1, characterized in that the molded elements (10; 12; 32) are assembled together into storage blocks by cementing.

4. Storage material of claim 3, characterized by a bonding of the molded elements (10; 12; 32) by means of adhesive cementing with the aid of cements on the basis of polyurethane, silicone, nonaminic epoxy resins or polyamide hot-melt adhesives.

5. Storage material of claim 3, characterized by a bonding of the molded elements (10; 12; 32) by means of diffusion cementing using a solvent for polyetherimide, preferably methylene chloride, in a concentration of 1 to 5%.

6. Storage material of claim 1, characterized in that the plate-like and the stick-like molded elements (10; 12; 32) have button-like or stick-like joining member (20; 24; 26) constituting snap fasteners in the junction areas to serve as alternating male and female fasteners for assembling the storage block.

7. Storage material of claim 3, characterized in that the plate-like molded elements (10) with stick-like molded elements (34; 36) formed thereon are constructed as integral combination elements (32).

8. Storage material of claim 1, characterized in that the storage blocks are composed of perforated, plate-like molded elements (10) and stick-like molded elements (12) provided with rivet heads.

9. Storage material of claim 8, characterized in that the stick-like molded elements (12) are joined with the plate-like molded elements (10) to form the storage block by swaging the rivet heads by means of ultrasound.

10. Storage material of claim 1, characterized in that the storage blocks are composed of slotted, plate-like and stick-like molded elements (10; 12), the stick-like molded elements (12) having molded studs (24) which are snapped into the slots (26) in the plate-like molded elements (10).

11. Storage material of any of claim 1, characterized in that the polyetherimide is reinforced by embedded fibers or fiber fabrics, preferably glass fibers or glass fiber fabrics.

* * * * *